US005659209A

United States Patent [19]

Huen

[11] Patent Number: 5,659,209

[45] Date of Patent: Aug. 19, 1997

[54] SUPPLY/LOAD ON/OFF SWITCHING ASSEMBLY

[75] Inventor: Hing Wah Huen, Kowloon, Hong Kong

[73] Assignee: Fairform Mfg. Co., Ltd., Hong Kong

[21] Appl. No.: 350,270

[22] Filed: Dec. 5, 1994

[51] Int. Cl.[6] ..... H01H 47/00

[52] U.S. Cl. ..... 307/125; 200/51 R; 200/51.02; 200/51.11; 200/43.02; 307/112; 307/116; 307/139

[58] Field of Search ..... 200/51 R, 51.02, 200/51.03, 51.04, 51.06, 51.11, 43.04; 307/112, 113, 114, 115, 116, 117, 125, 140, 139, 147

[56] References Cited

U.S. PATENT DOCUMENTS

| | | | |
|---|---|---|---|
| 3,928,737 | 12/1975 | Prasert | 307/114 |
| 4,485,282 | 11/1984 | Lee | 200/51 R |
| 4,578,593 | 3/1986 | Davidov | 307/113 |
| 5,036,214 | 7/1991 | Zerillo | 307/140 |
| 5,239,205 | 8/1993 | Hoffman et al. | 307/117 |

*Primary Examiner*—William M. Shoop, Jr.
*Assistant Examiner*—Jonathan S. Kaplan
*Attorney, Agent, or Firm*—Browning Bushman

[57] ABSTRACT

An electrical switching assembly which is formed by a base unit (10) and a control unit (11) having respective bodies which are releasibly engageable together through mechanical connection. The base unit (10) includes two supply terminals (20 & 21) for electrical connection to a power supply, two load terminals (22 & 23) for electrical connection to a load, and a built-in electrical switch (31) having an exposed operating member for manual operation. The electrical switch (31) is connected electrically in series between the power supply and the load terminals (20/21 & 22/23) in order to manually control the electrical connection of the load to the power supply. The control unit (11) includes a command receiver and an internal electrical switch (40) which is adapted to be connected electrically in series between the power supply and the load terminals (20/21 & 22/23) of the base unit (10) through the mechanical connection in order to control the electrical connection of the load to the power supply under the control of the command receiver upon receiving a switching control signal from a user or control device.

7 Claims, 3 Drawing Sheets

SUPPLY/LOAD ON/OFF SWITCHING ASSEMBLY

SUMMARY OF THE INVENTION

The present invention relates to an electrical switching assembly for controlling the supply of electrical power to a load.

According to the invention, there is provided an electrical switching assembly which is formed by a base unit and a control unit having respective bodies which are releasibly engageable together through mechanical connection, wherein the base unit includes two-supply terminals for electrical connection to a power supply, two load terminals for electrical connection to a load, and a built-in electrical switch having an exposed operating member for manual operation, said switch being connected electrically in series between the power supply and the load terminals in order to manually control the electrical connection of the load to the power supply, and wherein the control unit includes a command receiver and an internal electrical switch which is adapted to be connected electrically in series between the power supply and the load terminals of the base unit through the mechanical connection in order to control the electrical connection of the load to the power supply under the control of the command receiver upon receiving a switching control signal from a user or control device.

In a first preferred embodiment, the electrical switches of the base and control units are arranged to be connected electrically in parallel together through the mechanical connection such that when the electrical switch of the base unit is in an open condition, the electrical switch of the control unit is capable of controlling the electrical connection of the load to the power supply.

More preferably, the electrical switch of the control unit is normally open.

In a second preferred embodiment, the electrical switches of the base and control units are arranged to be connected electrically in series together through the mechanical connection such that when the electrical switch of the base unit is in a closed condition, the electrical switch of the control unit is capable of controlling the electrical connection of the load to the power supply.

More preferably, the electrical switch of the control unit is normally closed.

It is preferred that the mechanical connection between the bodies of the base and control units are effected through a power socket-and-plug connection.

In a specific construction, the body of the base unit has at least two electrical socket holes and the body of the control unit has at least two electrical plugs.

Preferably, the mechanical connection between the bodies of the base and control units is different from conventional power socket-and-plug designs.

It is preferred that the command receiver of the control unit is adapted to receive a wireless switching control signal.

Alternatively, the command receiver of the control unit is adapted to receive a wired switching control signal.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
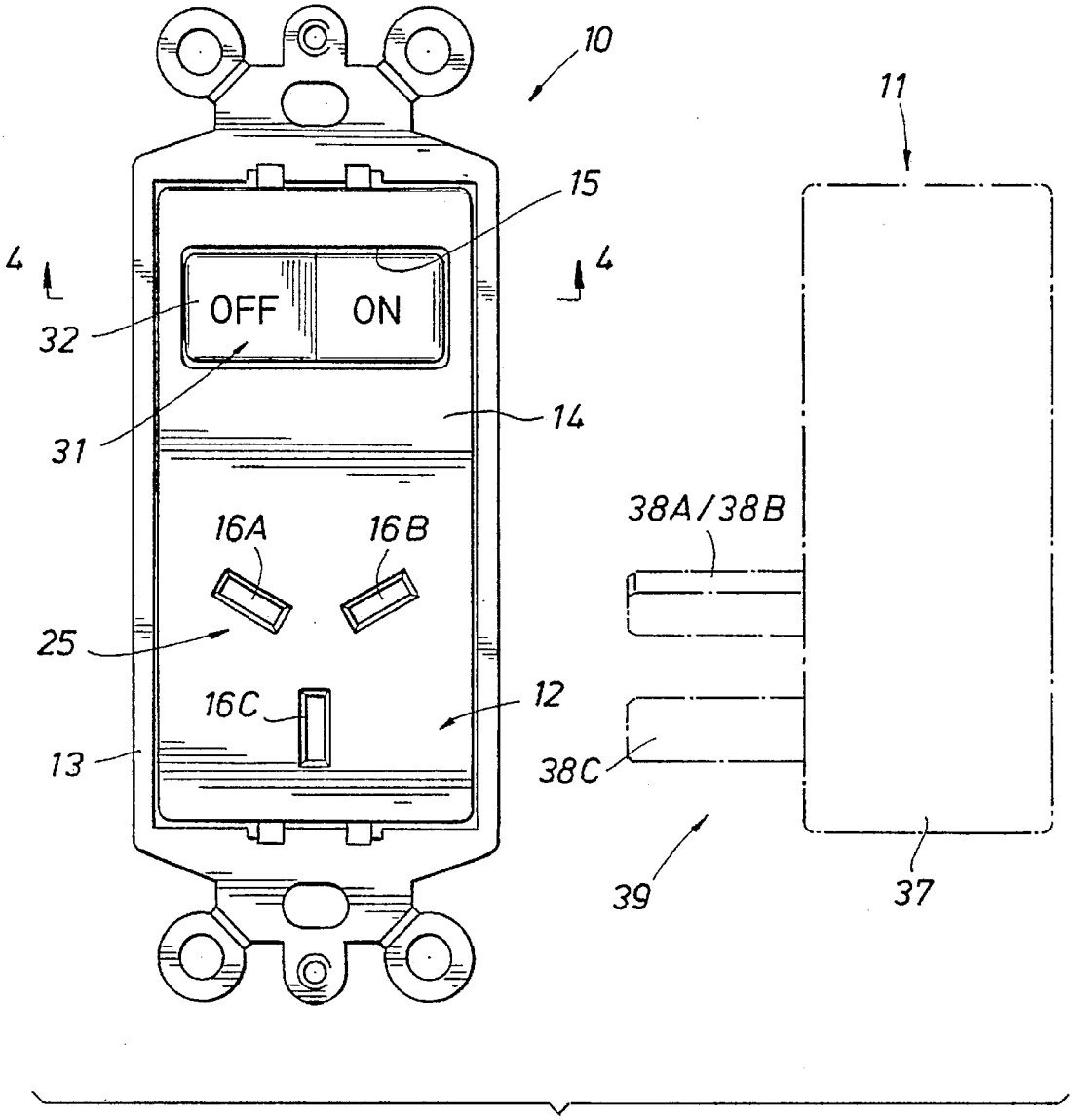
FIG. 1 shows a base unit and a control unit of an embodiment of an electrical switching assembly in accordance with the invention.
Figure 2:
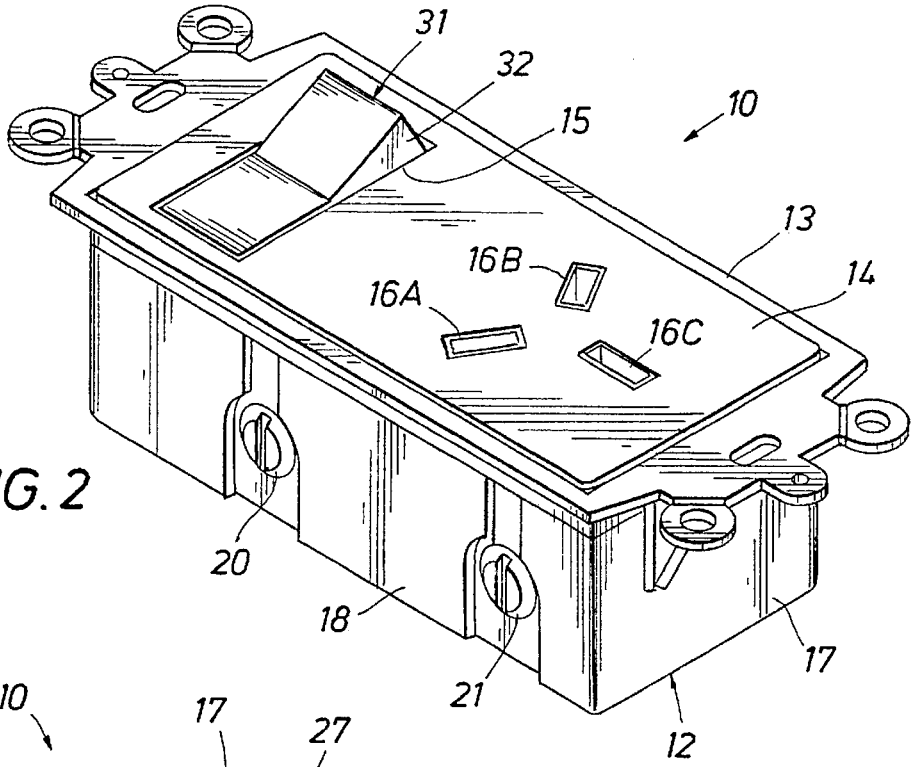
FIG. 2 is a perspective view of the base unit of FIG. 1.

Referring firstly to FIGS. 1 to 4 of the drawings, there is shown an electrical switching assembly embodying the invention, which switching assembly is formed by a base unit 10 and a control unit 11 which are separate but to be used together. The base unit 10 has a cuboidal body 12, around which a metal outer frame 13 is fitted for mounting the overall base unit in position, such as on a wall, for use. The body 12 has a rectangular front lid 14, in which a rectangular hole 15 is formed across one end and a group of three slots 16A to 16C are formed to extend radially relative to one another in a generally equi-angular manner.

Figure 3:
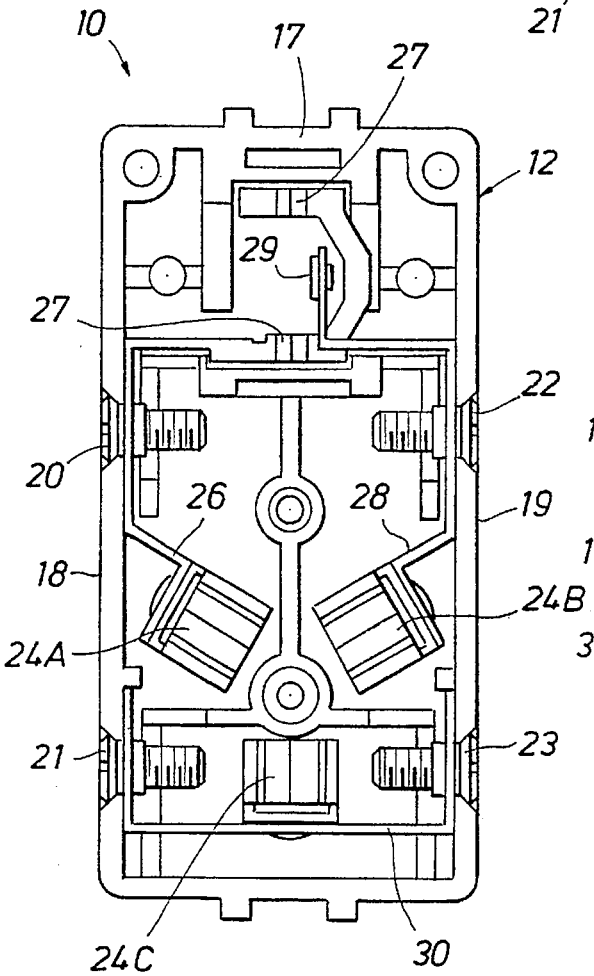
FIG. 3 is a front view showing the internal construction of the base unit of FIG. 2.
Figure 4:
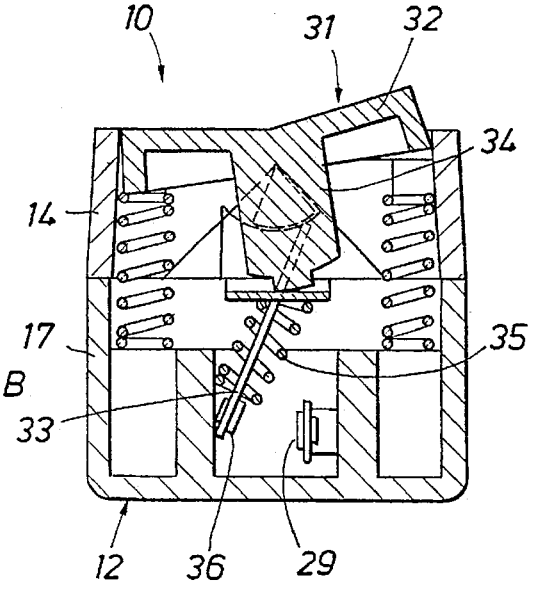
FIG. 4 is a cross-sectional end view of the base unit of FIG. 2.

The body 12 of the base unit 10 has a rectangular box-like base 17 which has opposite oblong sides 18 and 19. A pair of power supply terminals in the form of two terminal screws 20 and 21 is secured through one body side 18, and a pair of load terminals in the form of two terminal screws 22 and 23 is secured through the opposite body side 19. The terminal screws 20 and 22 are aligned with each other at a position adjacent (below as shown in FIG. 3) the hole 15 of the body lid 14. The terminal screws 21 and 23 are aligned with each other and with the slot 16C of the body lid 14.

Directly below the slots 16A to 16C of the body lid 14, three corresponding U-shaped terminal clips 24A to 24C are positioned, aligning therewith, to form a power socket 25 for an electrical plug having three flat pins (as hereinafter described). The first terminal clip 24A is supported by an electrically conducting strip 26 which extends past the first supply terminal screw 20, securing therewith, and terminates in the form of an aligned pair of seats 27. The second terminal clip 24B is supported by an electrically conducting strip 28 which extends past the first load terminal screw 22, securing therewith, and terminates in a fixed switch contact 29 located between the pair of seats 27 in a slightly offset position. The third terminal clip 24C is supported by an electrically conducting strip 30 which extends in opposite directions to secure with the second supply and load terminal screws 21 and 23, respectively. In this arrangement, the first terminal clip 24A is electrically connected to the first supply terminal screw 20 and the pair of seats 27, the second terminal clip 24B is electrically connected to the first load terminal screw 22 and the fixed switch contact 29, and the third terminal clip 24C is electrically connected to both of the second supply and load terminal screws 21 and 23.

The base unit 10 includes a built-in manual electrical switch 31 which is operable by means of a rocker 32 exposed through the hole 15 of the body lid 14. The rocker 32 incorporates a flat U-shaped electrically conducting contact plate 33 which is connected to a bottom end 34 of the rocker 32 by a compression coil spring 35. The contact plate 33 provides at its bottom end a movable switch contact 36, and has on its side limbs an aligned pair of outwardly extending side lugs which are arranged to engage in the corresponding seats 27. The rocker 32 is arranged to rock about the side lugs of the contact plate 33 bearing against the pair of seats 27, with the coil spring 35 compressed and the two top ends of the contact plate 33 bearing upwards against the rocker bottom end 34. In this arrangement, the contact plate 33 is pivotable about the rocker bottom end 34 to the same side as the rocker 32 is rocked, through an off-centre flipping motion under the action of the coil spring 35. Upon such a flipping motion of the contact plate 33, the movable switch contact 36 moves into or out of physical contact with the fixed switch contact 29, in a manner already known in certain existing electrical rocker switches.

Figure 5:
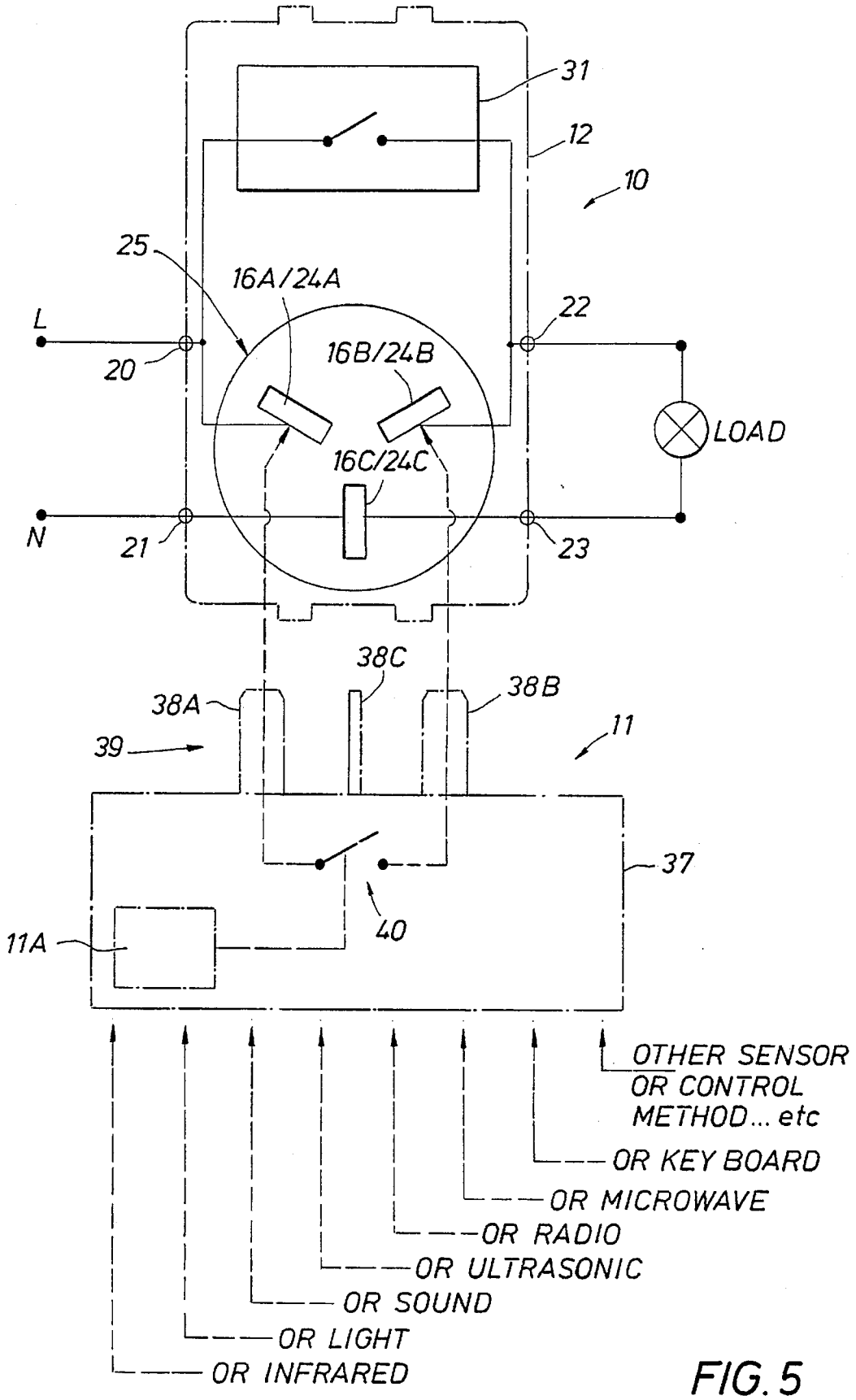
FIG. 5 is a schematic circuit diagram of the electrical switching assembly of FIG. 1, illustrating the electrical connection between the base and control units.

Reference is finally made to FIG. 5 of the drawings. The control unit 11 has a cuboidal body 37 and a group of three electrically conducting flat pins 38A to 38C protruding from one side of the body 37. The three flat pins 38A to 38C extend radially relative to one another in a generally equi-angular manner to form an electrical plug 39 arranged to engage, both mechanically and electrically, with the socket 25 of the base unit 10 through a conventional power plug/socket engagement. The control unit 11 incorporates an internal electrical (or electronic/solid-state) switch 40 which has a pair of make-and-break switch contacts electrically connected to the flat pins 38A and 38B respectively.

The control unit 11 further incorporates a command receiver adapted to receive a switching control signal from a user to operate the internal electrical switch 40. The command receiver 11A may have a sensor to receive a wireless control signal which may be in the form of, for example, infrared, light, sound, ultrasonic, radio or micro-wave emitted by a suitable remote controller. Alternatively, the command receiver 11A may be designed to receive a wired control signal generated by means of, such as, a computer keyboard. The construction and operation of such a command receiver is generally known in the art and thus will not be further described here. It is, however, envisaged that any other suitable sensors and control links may be used.

In operation, the base unit 10 is electrically connected between a power supply and a load by means of the supply and load terminal screws 20/21 and 22/23, respectively. The base unit 10 may be used on its own, in that the built-in electrical switch 31 is used to connect or disconnect the load to or from the power supply.

With the control unit 11 plugged onto the base unit 10, the internal electrical switch 40 of the control unit 11 is connected electrically in parallel with the built-in electrical switch 31 of the base unit 10. While the electrical switch 31 is switched open, the additional electrical switch 40 takes over the control of the connection between the load and the power supply. In this situation, remote control of the supply connection to the load is possible by means of the control unit 11 in combination with a suitable remote controller, computer or any other suitable controlling devices.

It is to be understood that when the additional electrical switch 40 is in an open condition, the original electrical switch 31 takes control over the supply/load connection. The additional electrical switch 40 is preferably normally open such that when the control unit 11 is not in use or deactivated, the original electrical switch 31 is readily in control, without the need to remove the control unit 11.

It is preferred that the socket 25 of the base unit 10 and the plug 39 of the control unit 11 are inter-engageable in a manner different from that of conventional power socket-and-plug designs, as in the described embodiment, in order to prevent the use of any un-matching control unit on the base unit 10, which may otherwise cause damage and/or control failure.

The invention has been given by way of example only, and various other modifications of and/or alterations to the described embodiment may be made by persons skilled in the art without departing from the scope of the invention as specified in the appended claims.

What is a claimed is:

1. An electrical switching assembly formed by a base unit and a control unit having respective bodies which are releasibly engageable together through mechanical connection, wherein the base unit includes two supply terminals for electrical connection to a power supply, two load terminals for direct electrical connection to a load, and a built-in first electrical switch having an exposed operating member for manual operation, said first switch being connected electrically in series between the power supply and the load terminals in order to manually control the electrical connection of the load to the power supply, and wherein the control unit includes a command receiver and an internal second electrical switch which is adapted to be operated by the command receiver and connected electrically directly in parallel with the first switch and in series between the power supply and the load terminals of the base unit through the mechanical connection in order to control, when the first switch is in an open condition, the electrical connection of the load to the power supply under the control of the command receiver upon receiving a switching control signal from a user or control device.

2. An electrical switching assembly as claimed in claim 1, wherein the electrical switch of the control unit is normally open.

3. An electrical switching assembly as claimed in claim 1, wherein the mechanical connection between the bodies of the base and control units are effected through a power socket-and-plug connection.

4. An electrical switching assembly as claimed in claim 3, wherein the body of the base unit has at least two electrical socket holes and the body of the control unit has at least two electrical plugs.

5. An electrical switching assembly as claimed in claim 3, wherein the socket-and-plug connection is provided by cooperable socket holes and plug pins which are arranged in a generally equiangular manner.

6. An electrical switching assembly as claimed in claim 1, wherein the command receiver of the control unit is adapted to receive a wireless switching control signal.

7. An electrical switching assembly as claimed in claim 1, wherein the command receiver of the control unit is adapted to receive a wired switching control signal.

* * * * *